US005954989A

United States Patent [19]

Brook et al.

[11] Patent Number: 5,954,989

[45] Date of Patent: Sep. 21, 1999

[54] EROSION AND ABRASION RESISTANT REFRACTORY COMPOSITION AND ARTICLE MADE THEREFROM

[75] Inventors: Roger W. Brook, Argyll, United Kingdom; Quentin K. Robinson, Pittsburgh, Pa.

[73] Assignee: Vesuvius Crucible Company, Wilmington, Del.

[21] Appl. No.: 08/821,158

[22] Filed: Mar. 20, 1997

[51] Int. Cl.[6] ..... B22D 41/08

[52] U.S. Cl. ..... 222/600; 222/606

[58] Field of Search ..... 222/591, 600, 222/606, 607

[56] References Cited

U.S. PATENT DOCUMENTS

| | | | |
|---|---|---|---|
| 3,970,283 | 7/1976 | Hind | 222/600 |
| 4,179,046 | 12/1979 | Jeschke et al. | 222/600 |
| 4,210,617 | 7/1980 | Bowman | 222/600 |
| 4,497,473 | 2/1985 | Robyn et al. | 266/44 |
| 4,775,504 | 10/1988 | Shikano et al. | 264/63 |
| 4,951,851 | 8/1990 | King et al. | 222/591 |
| 5,198,126 | 3/1993 | Lee | 222/606 |
| 5,335,833 | 8/1994 | Rancoule | 222/600 |
| 5,348,202 | 9/1994 | Lee | 222/606 |

FOREIGN PATENT DOCUMENTS

| | | |
|---|---|---|
| 0198237 | 10/1986 | European Pat. Off. . |
| 0346378 | 6/1993 | European Pat. Off. . |
| 62-182156 | 8/1987 | Japan . |
| 2065278 | 6/1981 | United Kingdom . |
| 2113806 | 8/1983 | United Kingdom . |
| 2220875 | 1/1990 | United Kingdom . |

OTHER PUBLICATIONS

Japanese Laid–Open Publication No. 08–059337, Mar. 5, 1996, Abstract, 1 p., English language.

Japanese Laid–Open Publication No. 62–182156, Aug. 10, 1987, Abstract, 1 p., English language.

Japanese Laid–Open Publication No. 08–132191, May 28, 1996, Abstract, 1 p., English language.

Japanese Laid–Open Publication No. 08–001319, Jan. 9, 1996, Abstract, 1 p., English language.

*Primary Examiner*—Scott Kastler

*Attorney, Agent, or Firm*—Webb Ziesenheim Logsdon Orkin & Hanson, P.C.

[57] ABSTRACT

A refractory pouring member such as a tundish nozzle or tube and integral plate for use in a slide gate valve or stopper rod valve system in continuous steel casting has selected portions made from an erosion and abrasion resistant refractory composition. The composition comprises: up to 95 wt. % $Al_2O_3$; up to 15 wt. % C; up to 10 wt. % $SiO_2$; and up to 3 wt. % antioxidant. At least an upper surface of the slide plate is formed from the erosion and abrasion resistant refractory composition to prevent in-service wear of the slide plate and a selected portion of the tube bore is formed of the erosion and abrasion resistant material, preferably extending a distance of about 50 to 300 mm from the top of the slide plate to protect the tube bore from the erosive action within a turbulent flow zone of molten metal which exists when the slide gate valve is in a throttling mode of operation. Pouring members having selected portions made from the erosion and abrasion resistant refractory material are particularly suited for use with tube changers for slide gate valves and for use in stopper rod systems used in the continuous casting of steel.

12 Claims, 4 Drawing Sheets

EROSION AND ABRASION RESISTANT REFRACTORY COMPOSITION AND ARTICLE MADE THEREFROM

BACKGROUND OF THE INVENTION

The present invention relates generally to refractory articles and compositions which are resistant to the erosive effects of molten steel as well as to hard refractory compositions which are resistant to abrasive wear. The present invention finds particular application in refractory pouring components, such as tubular nozzles and slide plates used in slide gate valves and in the continuous casting of steel.

In continuous steel casting operations, it is well-known to control the flow of molten metal from a ladle to a tundish and thence to the mold or molds by the use of a slide gate valve mechanism. The lowermost plate in such known slide gate valves carries the pouring nozzle. One of the refractory plates of a slide gate valve mechanism, sometimes referred to as the throttling plate, is movable so as to selectively bring the teeming bores in the refractory plates and pouring nozzle into and out of vertical alignment. When the teeming bores are in an axially aligned position, molten metal is free to flow and when the bores are in a completely misaligned position, all metal flow is stopped. In an intermediate or throttling position when the bores of the adjacent plates overlap such that their respective axes are offset, the molten metal flowing therethrough produces a turbulent flow zone downstream from the lowermost plate as a result of the restrictions caused by the offset bores. In present day steelmaking practice, it is also becoming more common to cast more chemically aggressive grades of steel which attack conventional materials and create an ever-increasing demand on the refractory components which contain and regulate the flow of the molten metal.

In the case of casting nozzles, the problem of refractory erosion is accelerated in the turbulent flow zone occurring in the upper portion of the nozzle bore when the slide gate plates are in the throttling position. This accelerated erosion caused by the turbulent flow and by the chemically aggressive steels results in premature failure in conventional alumina graphite refractory nozzles.

In addition, the flat surfaces of the refractory plates in slide gate valve mechanisms are subjected to high operating loads which cause abrasive wear when the plate surfaces slide relative to one another as the valve is opened and closed. It is, of course, advantageous to minimize such abrasive wear along the mating surfaces of adjacent refractory plates in order to prevent the infiltration of air into the molten metal stream which would have a deleterious effect on the quality of the steel being cast.

The prior art has recognized the need for providing casting nozzles with top plates or inserts along the top plate surface utilizing refractory materials of high hardness in an attempt to solve the abrasive wear problems alluded to above. It is also known to provide nozzle bores with bore sleeves or liners of various refractory compositions in an attempt to prevent or minimize the problem of nozzle bore blockage caused by the deposition and accumulation of alumina. Such refractory compositions used to prevent alumina deposition, however, are susceptible to erosion, particularly in the turbulent throttling zone in the upper region of the casting nozzle bore.

The present invention solves the problems heretofore encountered by providing a refractory composition and a casting member made therefrom which resists the erosive and corrosive effects of a turbulent molten steel. In addition, the refractory composition and casting member of the present invention possesses a hard, abrasive resistant surface which is particularly suited for use in the sliding plate surfaces of slide gate valves.

SUMMARY OF THE INVENTION

Briefly stated, the present invention is directed to a refractory composition and a casting member made therefrom having selected portions formed of said composition for resisting erosion and abrasive wear in continuous casting operations. The refractory composition of the present invention is directed to a high alumina material broadly comprising, up to 95 wt. % alumina, no more than 15 wt. % carbon, 10 wt. % maximum silica and up to about 3 wt. % antioxidant.

A presently preferred composition of an erosion and wear resistant refractory according to the present invention comprises on a dry mix basis about 75–95 wt. % $Al_2O_3$; 5–15 wt. % C; 2–8 wt. % $SiO_2$; and 0.5–3 wt. % of one or more boron containing antioxidants. A presently preferred casting member according to the invention is in the form of a so-called monoblock tundish nozzle comprising a top sliding plate portion and a lower nozzle portion integral therewith. The plate and nozzle portions of the monoblock are preferably copressed and fired to form a monolithic refractory article. A teeming bore extends axially through the plate and nozzle portions to permit the passage of molten steel therethrough when the monoblock is mounted to a slide gate valve. The entire upper surface of the plate portion of the monoblock and the surface surrounding the upper region of the teeming bore in the nozzle portion are made from the erosion and wear abrasion resistant refractory composition of the invention. The upper region of the teeming bore in the nozzle is thus protected from the erosive effects of turbulent molten steel caused by the throttling action of the slide gate plates. In this regard, the wear and erosion resistant refractory composition extends from the plate portion downwardly along the bore of the nozzle portion, preferably a distance of between about 50 to about 300 mm from the upper plate surface to fully encompass the turbulent flow zone of the molten steel. Alternatively, the entire length of the bore may be formed from the erosion and abrasion resistant refractory material. The balance of the plate and body of the nozzle are made from a conventional, thermal shock resistant refractory composition of, for example, alumina graphite, containing on the order of about 65 wt. % $Al_2O_3$; 25 wt. % C; and the balance one or both of $SiO_2$ and $ZrO_2$. The body of the nozzle portion may also have a conventional slagline sleeve of, for example, a known zirconia graphite refractory composition, formed around an outer periphery of the nozzle to provide protection to the submerged nozzle body during continuous casting.

The various attributes and advantages of the invention will become more apparent when reference is made to the following detailed description taken with the appended drawings.

DETAILED DESCRIPTION OF THE INVENTION

Figure 3:
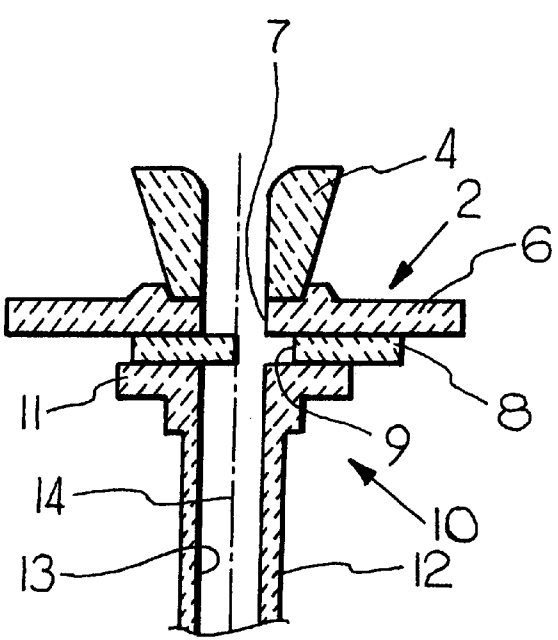
FIGS. 1–3 are a series of schematic, cross-sectional side views of a conventional slide gate valve sequentially moving from a fully open position in FIG. 1 to a fully closed position in FIG. 2 to a throttled position in FIG. 3.
Figure 2:
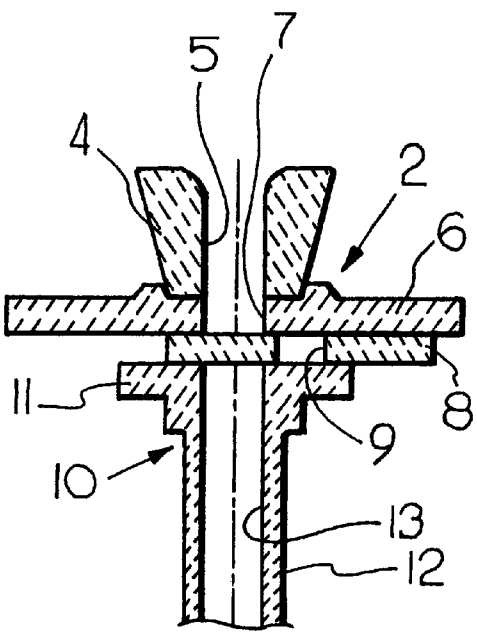
Figure 1:
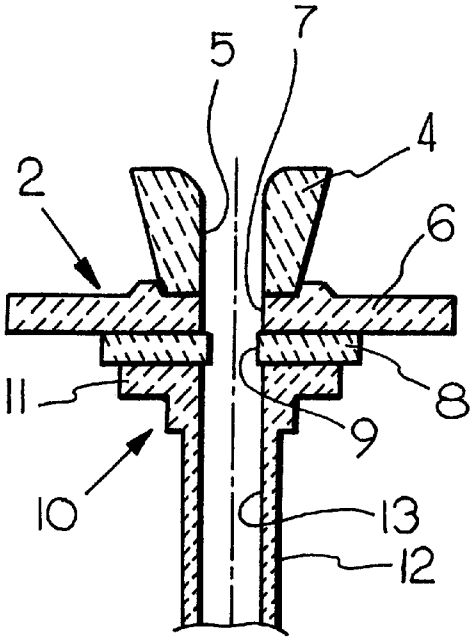

FIGS. 1–3 schematically depict the sequential operation of a conventional slide gate valve mechanism 2 of the type commonly used in controlling the flow of molten metal from a metallurgical vessel such as a ladle or tundish. The slide gate valve 2 is affixed to a nozzle 4 in the form of a known collector nozzle or well block nozzle fitted in the bottom of the metallurgical vessel (not shown). The nozzle 4 has an axial bore 5 therethrough which permits molten metal to be teemed from the bottom of the tundish for subsequent delivery to a continuous casting mold or molds (not shown). The known slide gate valve 2 for use with a tundish includes three major plate components, namely, an upper stationary plate 6, a middle, movable plate 8 (also referred to as a throttling plate) and a lowermost stationary bottom plate 11. The plate 11 may be part of a unitary refractory article, such as a so-called tundish monoblock nozzle 10 shown in FIGS. 1–3. The monoblock nozzle 10 comprises an upper plate portion 11 and a copressed, integral tube or nozzle portion 12. It is also conventional and well-known in the art to provide a pouring tube and upper plate as an assembly of individual components having mechanical means to hold the separate tube and upper plate components together. In the practice of the present invention, however, it is preferred to manufacture the plate portion 11 and pouring tube 12 in the form of a unitary copressed and fired monolith, as embodied in the tundish tube and integral slide plate of the monoblock nozzle 10, the particular aspects of which will be explained in greater detail hereinafter.

The upper stationary plate 6 of the slide gate valve 2 has a bore 7 which is axially aligned with the bore 5 of the nozzle 4. In addition, the middle plate 8 has a through bore 9 and, in like manner, the lower plate 11 and tube 12 of the monoblock 10 have a bore 13 therethrough which is axially aligned with the bores 5 and 7 of the stationary nozzle 4 and upper plate 6, respectively.

The slide gate valve 2 is in a fully open position as shown in FIG. 1 when the middle plate 8 is moved to a location where its bore 9 is axially aligned with the bores 7 and 13 of the upper and lower plates 6 and 11, respectively, of the valve. In the fully open position of FIG. 1, molten metal is teemed from the tundish to a continuous casting mold or molds, all of which is well-known in the art of steelmaking.

When the middle plate 8 is moved to the location shown in FIG. 2, the bore 9 is totally out of register with the bores 7 and 13, causing the valve 2 to assume a fully closed position. In the fully closed position, no molten metal can pass from the bore 7 since a solid refractory portion of plate 8 blocks the pathway between the bores 7 and 13. As the middle plate 8 is moved between the fully closed and fully open positions, the plate 8 assumes a throttling position depicted in FIG. 3 in which the axis of the bore 9 is partly out of register with the axes of bores 6 and 13. In this manner, the slide gate valve 2 controls the flow of metal to the continuous casting mold.

When the slide gate valve 2 is in the throttling position of FIG. 3, the stream of molten metal forms a turbulent flow zone 14 at a location within the upper part of the bore 13 of the tube portion 12 of the monoblock nozzle 10. The turbulent zone is caused by an increased flow velocity created by the decreased effective cross-section of the bore 9 and/or by the somewhat tortuous flow pathway created by the axially offset bores 7, 9 and 13 when the middle plate 8 is throttled. In any event, the turbulent flow of the liquid steel causes accelerated erosion of the refractory material along the upper regions of the bore 13 in and around the turbulent flow zone 14. The erosive action of the liquid steel will cause eventual thinning of the refractory side wall along the turbulent flow zone 14 resulting in premature failure of the tube portion 12 of the monoblock nozzle 10. More chemically aggressive grades of steel also accelerate this problem in conventional refractory compositions such as alumina graphite.

It is also well-known to employ a tube changer mechanism with the slide gate valve to replace a worn or otherwise spent tundish tube and plate monoblock nozzle during continuous casting operations. When a new tundish tube and plate monoblock nozzle 10 is slid into place, the plate oftentimes contacts partially solidified steel which drips from the bore of the plate 8. Hence, the surface of the refractory of the plate 11 must be abrasion resistant so that it can slide without being gouged by metal which might drip onto the sliding plate as it moves beneath the plate 8. In addition, the sliding movement of the throttling plate 8 along the surface of the plate portion 11 of the monoblock nozzle 10 causes abrasive wear thereto. Mishandling of the refractory parts during tube changing operations may also cause gouging in conventional refractory plates. If such abrasive wear or gouging becomes excessive, small gaps or openings will appear between the refractory plates 8 and 11 which may permit harmful infiltration of air into the stream of molten metal flowing through the teeming bore 13. Such air infiltration causes unwanted oxidation of the metal and consequent quality problems in the subsequently cast product.

The present invention thus provides a solution to the dual problems of erosion in the tube bore 13 and abrasive wear along the upper surface of the top plate portion 11 of a tundish monoblock nozzle and integral sliding plate.

It should be noted that it is also conventional in the art to employ a two-plate slide gate valve on ladles in place of the three-plate tundish valve 2 depicted in FIGS. 1–3. The two-plate slide gate valve is commonly used to regulate metal flow from the ladle to the tundish in a continuous casting system. In such two-plate ladle slide gate valves, the central plate 8 is removed and only the upper plate 6 and lower nozzle plate 10 are employed. Thus, in two-plate slide gate valves, the nozzle plate 10 is movable and the upper plate 6 is stationary. When the plate 10 is throttled, a turbulent zone 14 is again created, as discussed above with respect to the three-plate valve.

Figure 4:
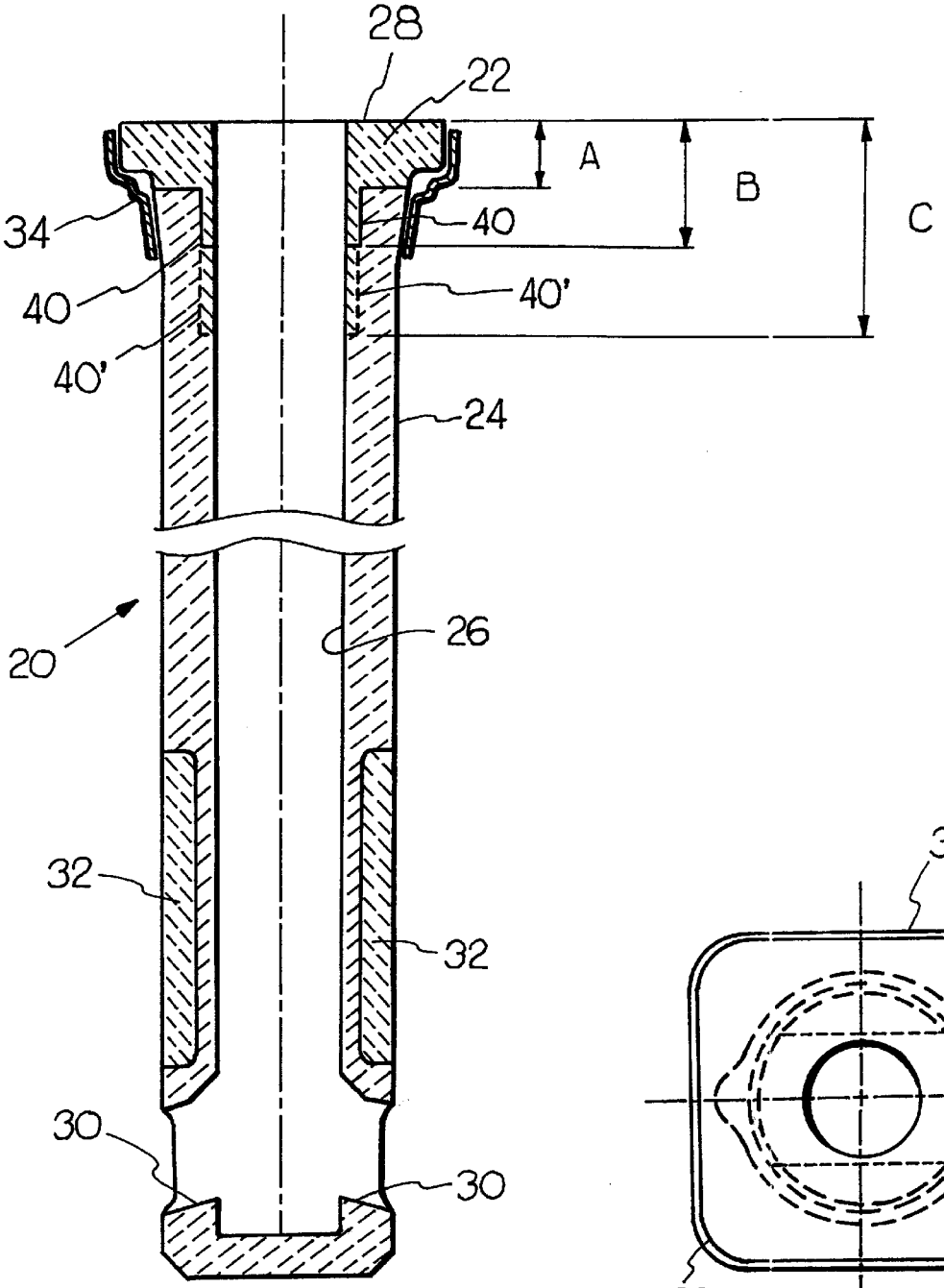
FIG. 4 is a cross-sectional side elevation view of a casting member of the present invention.
Figure 5:
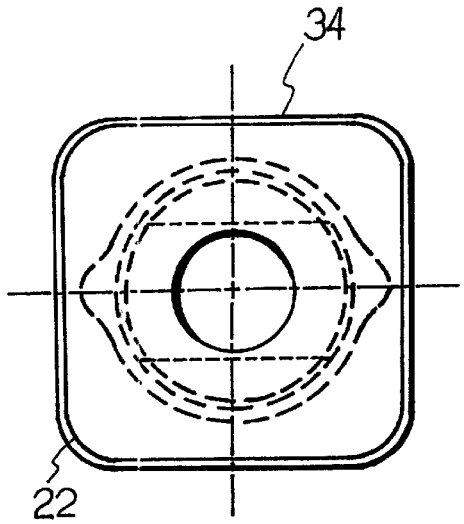
FIG. 5 is a top plan view of the casting member of FIG. 4.

A monoblock tundish nozzle casting member 20, according to the present invention, is shown in FIGS. 4 and 5. The monoblock nozzle casting member 20 is used in a similar manner as the monoblock nozzle 10 described above with references to FIGS. 1–3. The monoblock nozzle 20 includes an upper plate portion 22 and an integral copressed nozzle or tube portion 24 having an axial bore 26 formed therethrough. The bore 26 extends from an upper surface 28 of the plate portion 22 downwardly through the nozzle or tube position to a plurality of discharge orifices 30, all of which are conventional in known submerged casting nozzles and shrouds. The monoblock 20 also includes a conventional slagline sleeve 32 of a known corrosion resistant refractory material such as zirconia graphite material. The slagline sleeve 32 extends around the outer circumference of the tube portion 24 and is intended to protect the nozzle of the monoblock 20 against the corrosive effects of the chemically aggressive mold powder which floats on the surface of the molten metal in the continuous casting mold. The slagline sleeve 32 is preferably copressed with the tube portion 24 and plate portion 22, which is also conventional and well-known in the art.

According to the present invention, an erosion resistant and abrasion resistant refractory material is employed to form the top plate portion 22 as well as a region 40 surrounding the turbulent metal flow zone in an upper part of the nozzle bore 26. The body of the tube portion 24 of the monoblock casting member 20 is made from a conventional refractory such as alumina-graphite which exhibits good overall physical properties, particularly thermal shock resistance. The erosion resistant region 40 extends downwardly from the plate portion 22, preferably a distance equivalent to the length of the turbulent metal flow zone 14 of FIG. 3, namely, a distance sufficient to protect the conventional refractory material of the body of the tube portion 24.

By way of example, in the monoblock casting member 20 depicted in FIG. 4, the top plate portion 22 is made entirely from the erosion and abrasion resistant refractory material of the invention, which includes the entire upper surface area 28 intended to bear against and slide along the surface of an adjacent slide gate plate, such as the throttling plate 8 in the three plate slide gate valve of FIGS. 1–3 or against a stationary upper plate in a two-plate slide gate valve. The improved refractory material of the invention forming the top plate 22 extends a distance of between about 35 to 45 mm and preferably about 40 mm from the upper surface 28, as indicated by the dimension "A" in FIG. 4, which is slightly in excess of the entire thickness of the top plate 22. Thus, in the embodiment depicted in FIG. 4, the top plate 22 of the monoblock casting member 20 is formed completely from the wear and erosion resistant refractory material of the present invention. The erosion resistant region 40, also made from the novel refractory of the invention, extends downwardly from the upper surface 28 of the plate portion 22 a distance of between about 50 to 80 mm and preferably about 75 mm, as indicated by the dimension "B" in FIG. 4. The length of the erosion resistant zone 40 is determined, of course, by the extent and location of the turbulent metal flow zone created in a given slide gate valve geometry. In many cases, a length between 50–75 mm for the erosion resistant region 40 will be sufficient to fully protect the bore 26 of the tube 24 from the effects of the turbulent metal flow. In some installations, it may be necessary to extend the length of the erosion resistant region 40 as indicated by phantom lined element 40' in FIG. 4. This extended length is indicated by dimension "C" in FIG. 4 and may be on the order of about 150 mm, as measured from the upper surface 28 of the top plate portion 22. The erosion resistant sleeve forming the regions 40 or 40', positioned around the upper part of the nozzle bore 26, is between about 5 to 15 mm in thickness, more preferably about 8 to 10 mm in thickness.

The erosion and abrasion resistant refractory material of the present invention used to form the upper plate portion 22 and the erosion resistant region or sleeve 40, 40' preferably comprises, in a pressed and fired state, about 75–95 wt. % $Al_2O_3$; 5–15 wt. % C; 2–8 wt. % $SiO_2$; and up to about 3 wt. % boron containing antioxidant. The composition of the invention more preferably comprises about 80–90 wt. % $Al_2O_3$; about 5–12 wt. % C; about 3–7 wt. % $SiO_2$; and up to about 0.5–2.5 wt. % boron containing antioxidant. Still more preferably, the composition of the refractory of the present invention comprises about 84–87 wt. % $Al_2O_3$; about 6–10 wt. % C; about 4–6 wt. % $SiO_2$; and about 1–2 wt. % boron containing antioxidant. Antioxidants are well-known in the art used to protect the carbon constituent and, as used herein, the terms "boron containing antioxidant" and "antioxidant" include boron compounds and silicon compounds.

The body of the nozzle or tube portion 24, that is, the portions of the casting member not occupied by the top plate portion 22, slagline sleeve 32 and the erosion resistant sleeve 40, 40', is formed from a conventional refractory material such as an alumina graphite or an alumina-graphite material containing silica and zirconia additions. A typical composition for the body of the tube portion 24 which exhibits excellent thermal shock properties may contain, for example, about 65 wt. % $Al_2O_3$; 25 wt. % C (predominantly graphite); 5 wt. % $SiO_2$; and 5 wt. % $ZrO_2$.

The monoblock nozzle 20 is manufactured by a conventional isostatic pressing process in which the refractory mixes making up the body of the nozzle or tube portion 24, the slagline sleeve 32, the top plate 22 and erosion resistant region or sleeve 40 are copressed in a mandrel mold and subsequently thermally treated in a known manner to achieve the desired properties such as density/porosity, strength and the like. The fired member 20 may have a steel can 34 installed around the top plate 22 to serve as a mounting means to protect the underlying refractory material when the member 20 is handled by a tube changer mechanism and installed and used in a slide gate valve.

Of course, it will be understood that the erosion resistant sleeve 40 also may be formed to extend over the full length of the bore 26 of the tube portion, if desired. A full length erosion resistant sleeve is not necessary, however, in most applications and may add cost to the product since conventional casting tubes are relatively long. By way of example, a typical pouring nozzle is on the order of from about 700 to 900 mm, or greater, in length.

Figure 6:
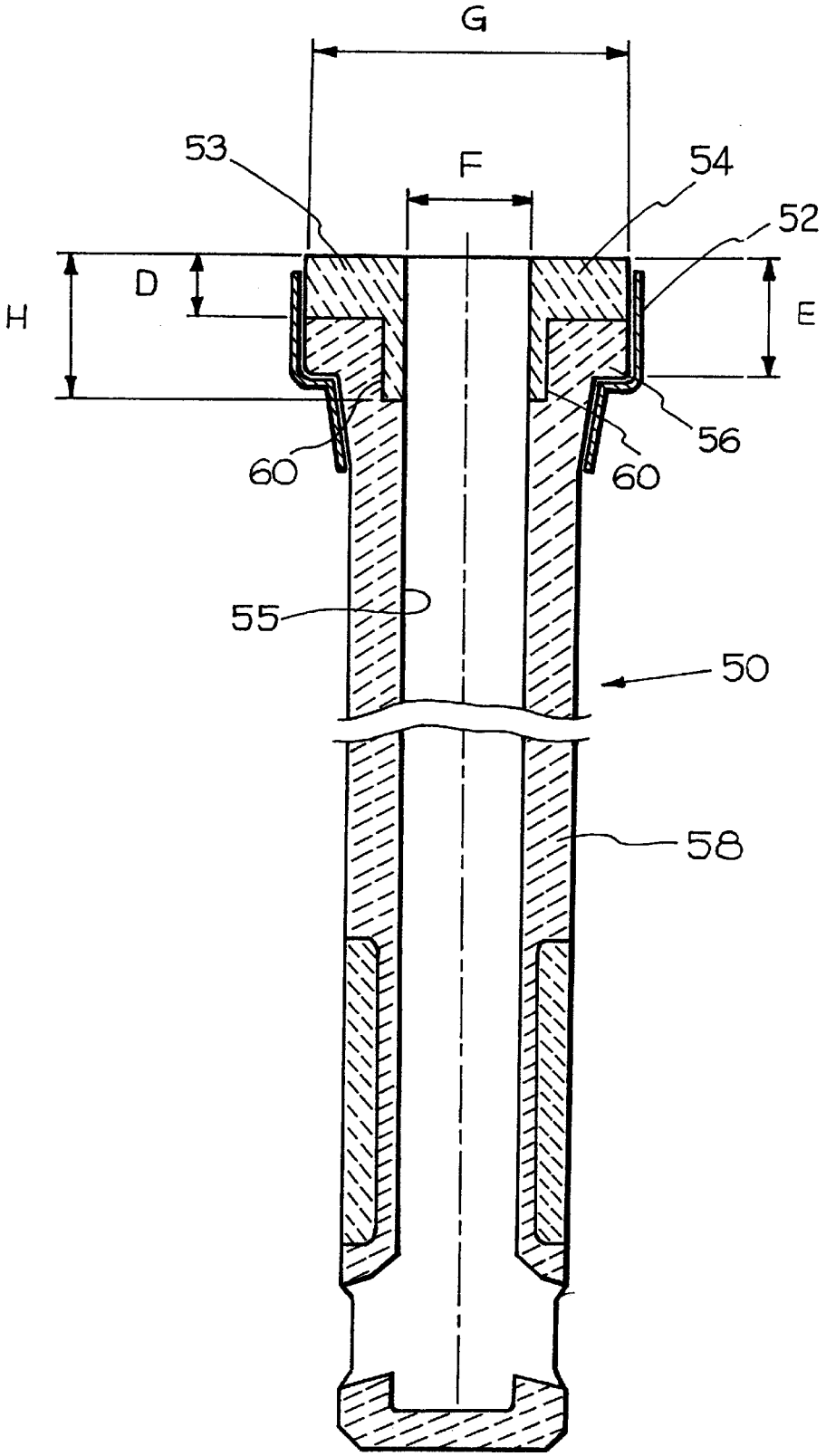
FIG. 6 is a cross-sectional side elevation view of a casting member according to the present invention, similar to the member depicted in FIG. 4.

A monoblock casting member 50 shown in FIG. 6 is similar in most respects to the monoblock casting member 20 of FIGS. 4 and 5, except with respect to the composition of the top plate portion 52. Approximately the upper half thickness of the top plate portion 52 in the embodiment of FIG. 6 including an upper surface 53 is made up of the erosion and abrasion resistant refractory composition of the present invention, the composition being identified by element 54 in FIG. 6. In the previously described embodiment of FIGS. 4 and 5, substantially the entire thickness "A" of the top plate portion 22 of the monoblock 20 is formed from the erosion and abrasion resistant refractory composition of the invention. In both embodiments, the respective upper surfaces 28 and 53 of the top plate portions 22 and 52, respectively, are formed from the improved refractory composition.

In FIG. 6, the erosion and abrasion resistant refractory portion 54 may be about 20 to 50 mm in thickness and nominally is about 30 mm in thickness, dimension "D", in a preferred embodiment, where the overall thickness of the top plate portion 52 is about 65 mm in thickness, dimension "E". The balance of the refractory material forming the top plate portion 52 indicated by reference numeral 56 is the same conventional refractory as used for the body of the nozzle or tube portion 58, such as, for example, an alumina-graphite material, as discussed previously in connection with the monoblock nozzle 20.

By way of further example, the monoblock nozzle 50 of FIG. 6 has a teeming bore 55 which may be, for example, on the order of about 75 mm in diameter, dimension "F". The upper surface 53 of the top plate portion 52 has a slightly rectangular shape when viewed from the top in plan view (similar to FIG. 5) and is about 200 mm wide, dimension "G" in FIG. 6. The erosion resistant sleeve 60, also made from the improved refractory composition of the present invention, extends along the turbulent metal flow zone a distance of about 50 to 300 mm, and more preferably about 70–150 mm, dimension "H", as measured from the upper surface 53 of the top plate portion 52. A nominal, preferred length of the erosion resistant sleeve 60 shown in FIG. 6 is about 75 mm.

Figure 7:
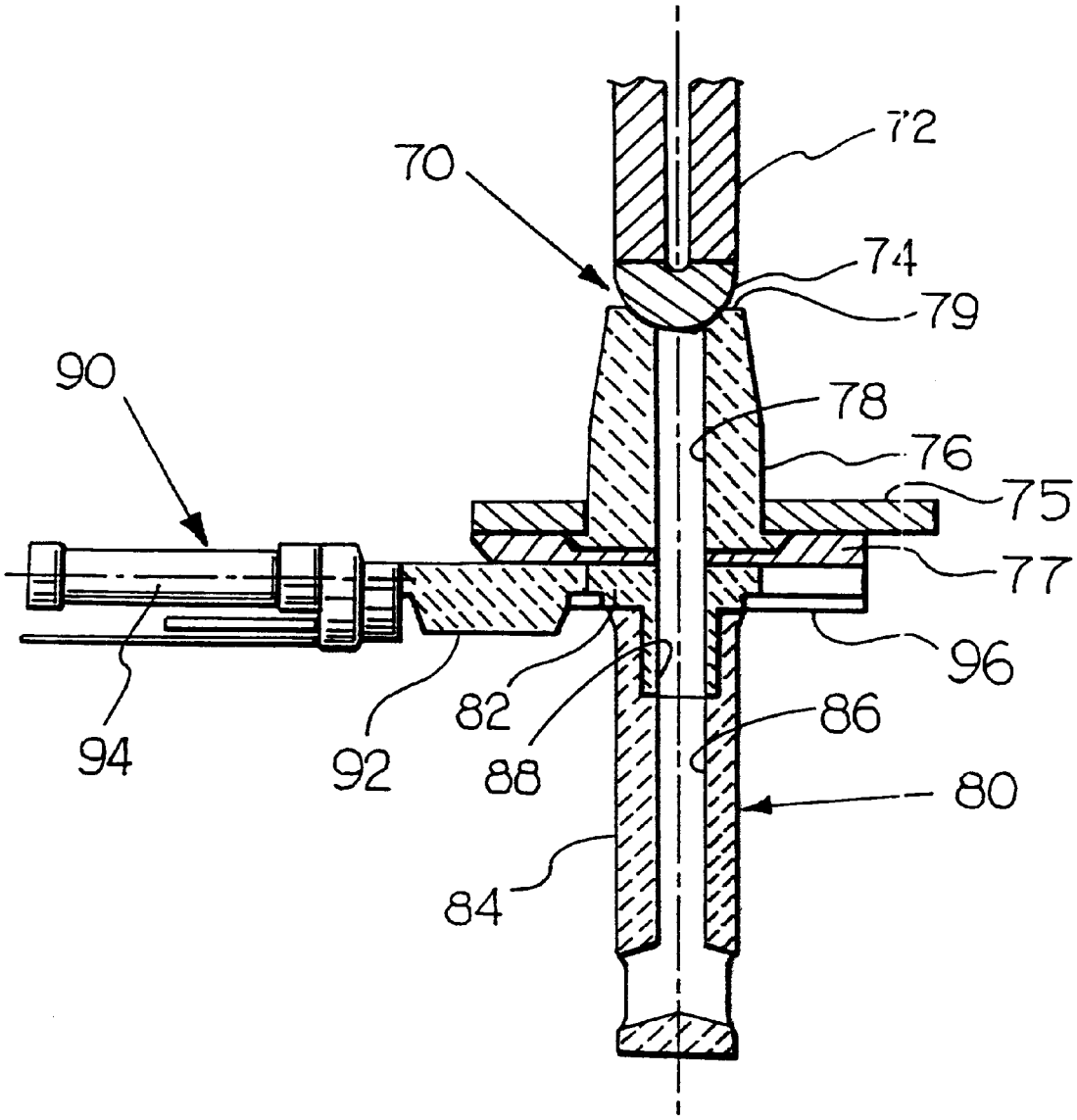
FIG. 7 is a cross-sectional side elevation view of a tundish flow control system of the stopper rod type shown in use with a tube changer apparatus, employing a casting member of the present invention.

In addition to pouring tubes and tube changer apparatus relating to slide gate valves discussed above, the present invention is applicable for use in connection with tundish flow control systems which also utilize tube changers but employ stopper rods to control the flow of steel from the tundish to a continuous casting mold. Such a tundish flow control system 70 is shown in FIG. 7. A tundish collector nozzle 76 is mounted within an orifice in the bottom wall 75 of the tundish and includes a nozzle plate 77 positioned exterior of the tundish wall 75. The collector nozzle has an axial bore 78 for the passage of molten metal therethrough for delivery to a bore 86 of a monoblock tundish plate and nozzle 80 and thence to the continuous casting mold (not shown).

The delivery of metal from the tundish in the flow control system 70 of FIG. 7 is controlled by a stopper rod 72. The stopper rod 72 is conventional and includes a nose portion 74 which, in FIG. 7, is shown as being in contact with a top surface 79 of the collector nozzle 76. In this position, the control system 70 is closed and no metal can flow from the tundish. When the stopper rod 72 is raised, the nose 74 moves upwardly from the position shown in FIG. 7 to permit metal to flow from the tundish into the continuous casting mold. The rate of metal flow may then be controlled by the distance the nose 74 of the stopper rod is moved from the top 79 of the collector nozzle.

The flow control system 70 also includes a conventional tube changer apparatus 90 which permits the operator to change the monoblock tundish nozzle and plate 80 by actuation of a hydraulic cylinder 94. The cylinder 94 moves a ram to forcibly cause the ejection of a worn or otherwise spent monoblock 80 and replacement with a fresh monoblock 80 so that a continuous casting campaign can continue without undue interruption. A solid safety plate 92 is also shown in FIG. 7 and is used to shut-off the flow control system 70 in the event of a stopper rod problem.

The problems discussed above in connection with monoblock pouring nozzles and plates used in slide gate valve systems also exist in the known stopper flow control system 70. The monoblock plate portion 82 is subject to abrasive wear and the upper region of the bore 86 of the tube portion 84 is subjected to erosion due to turbulent metal flow as the metal flow is throttled by movement of the stopper rod.

When the monoblock nozzle and plate 80 requires changing, the stopper rod 72 is lowered to close off the bore 78 of the collector nozzle. Some small amount of molten metal remains along the surface of the collector nozzle bore 78 which begins to partially solidify as the tube changer 90 moves a new monoblock plate and nozzle 80 into position. The plate portion 82 of the monoblock 80 is mounted for sliding movement along the tube changer frame 96 and is forcibly urged against the surface of the nozzle plate 77 by a plurality of spring-loaded members (not shown), the structure of which is well-known in the art. As discussed above in connection with the changing of plates and tubes in slide gate valves, the semi-solid, partially solidified metal residue left in the collector nozzle bore 76 may drip from the lowermost end of the bore 76 as the new monoblock plate and nozzle 80 is being slid into position. If partially solidified metal is present at the interface between the collector nozzle plate 77 and the plate portion 82 of the monoblock, the new plate must possess an abrasion resistant surface to prevent gouging by any residual drops of metal in order to preserve a flat plate surface and thereby prevent air infiltration into the metal stream passing through the system 70.

The monoblock tundish plate and nozzle 80 used in the flow control system 70 of FIG. 7 is thus subjected to the same rigorous service conditions as present in the above-discussed slide gate valves. Accordingly, the upper plate portion 82 and the upper bore portion 88 of the monoblock casting member 80 are made from the erosion and abrasion resistant refractory material of the present invention. The hard, abrasive resistant properties of the refractory permit the plate portion 82 to slide over any metal residue which may drip from the collector nozzle bore without gouging the plate surface. The upper portion 88 of the nozzle bore is resistant to the erosive effects of turbulent metal flow caused when the stopper rod 72 is in a raised position since bore portion 88 is also made from the abrasion and erosion resistant refractory composition of the invention. Thus, tube life is extended due to the increased protection provided in the turbulent metal zone.

In order to demonstrate the improved physical properties of the refractory composition of the invention, three refractory mixes were made identified as: "A", "B" and "C" having the compositions set forth in Table I, below. Refractory compositions "A" and "B" are those of the invention. The test pieces under the "A" and "B" headings differ slightly in composition and also in the thermal treatment given each piece after pressing, which will be explained in greater detail hereinafter. Composition "A" is a preferred material for use in "throttling" applications where the flow of steel is controlled in a slide gate valve system utilizing the apparatus and casting elements depicted in FIGS. 1–6. Composition "B" is a preferred material for use in "non-throttling" applications wherein the movement of a stopper rod controls the flow of steel as shown in FIG. 7. The requirement for higher strength, hardness and abrasion resistance is more stringent in the throttling application than in the non-throttling application. Although both compositions, "A" and "B", could be used in either application, composition "A" is the preferred material for use in the throttling slide gate valve application and composition "B" is preferred in the stopper rod flow control system application. Composition "C" in Table I is a conventional alumina-graphite refractory body mix for comparison purposes.

TABLE I

| Constituents | A | B | C |
|---|---|---|---|
| $Al_2O_3$ | 86.0 | 84.2 | 65 |
| $SiO_2$ | 5.5 | 4.6 | 4 |
| $ZrO_2$ | — | — | 5 |
| $B_2O_3$ | 1.8 | 1.5 | 2 |
| C | 6.7 | 9.7 | 24 |
| Thermal Process | >1100° C. | >800° C. | >800° C. |

Test pieces made from the various mixes A–C were isostatically pressed and then thermally treated.

Composition "A" is typically heat treated in a reducing atmosphere at temperatures above 1100° C. to produce the desired properties listed in Table II. However, the material of composition "A" may also be fired at lower temperatures, for example, greater than 800° C. and still form a useful product, albeit, with somewhat inferior properties, such as higher porosity and lower strength compared to the high temperature fired material of composition "A".

Composition "B" is typically heat treated in a reducing atmosphere at temperatures above 800° C. to yield the physical properties set forth in Table II. However, the material of composition "B" may also be fired at higher temperatures, greater than 1100° C., to form a useful product with somewhat superior properties, such as lower porosity and higher strength. The higher temperature firing causes additional sintering/densification which usually lowers the porosity and increases the strength levels.

The thermally treated test pieces made according to the compositions set forth in Table I were then tested to determine various physical properties such as hot modulus of rupture (MOR) at 1480° C., cold MOR at room temperature, apparent porosity (A.P.), apparent specific gravity (A.S.G.) and bulk density (B.D.). The physical properties so determined are reported below in Table II.

TABLE II

| Property | A | B | C |
|---|---|---|---|
| Hot MOR (1480° C.) | 2000 psi | 1200 psi | 1200 psi |
| Cold MOR | 3800 psi | 1450 psi | 800 psi |
| A.P. | 14.0 | 17.6 | 22.5 |
| A.S.G. | 3.57 | 3.45 | 3.2 |
| B.D. | 3.07 | 2.84 | 2.5 |

It will be readily appreciated from the foregoing Tables that the refractory composition of the present invention represented by test piece of composition "A" possesses superior strength at elevated temperatures and at room temperature as evidenced by the hot and cold MOR test results, respectively. In addition, the low fired test piece of composition "B" exhibited higher strength levels than the conventional alumina graphite material of composition "C" typically used in steel casting operations.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A tundish nozzle and plate for use with a tube changer mechanism of a flow control valve of a continuous steel casting apparatus comprising:

a plate portion having a bore therethrough;

a tube portion copressed with said plate portion and having a bore therethrough axially aligned with the bore of the plate portion to permit molten steel to pass therethrough when the flow control valve is selectively operated;

an erosion and abrasion resistant refractory material forming at least an upper surface of the plate portion and a surface surrounding the respective bores of the plate and tube portions, said surface extending from the upper surface of the plate portion downwardly a distance 50 to 300 mm from the upper surface of the plate portion to encompass a turbulent metal zone existing in the tube bore when the flow control valve is in a throttling position; and said erosion and abrasion resistant refractory comprising a high alumina, carbon bonded material containing more than about 80 wt. % alumina and less than about 15 wt. % carbon.

2. The tundish nozzle and plate of claim 1 wherein the tube portion includes a tube body formed from an alumina-graphite refractory material and said tube portion includes a slagline sleeve formed on an outer periphery thereof formed from a zirconia-graphite refractory material.

3. The tundish nozzle and plate of claim 1 wherein the erosion and abrasion resistant refractory surface extends downwardly in said tube bore substantially an entire length of said bore.

4. The tundish nozzle and plate of claim 1 wherein the flow control valve is a slide gate valve.

5. The tundish nozzle and plate of claim 1 wherein the flow control valve is a stopper rod valve.

6. A refractory pouring member for use in continuous casting of steel, the pouring member including a plate having a bore extending therethrough for the passage of molten steel from a metallurgical vessel, said plate having at least a surface portion formed from an erosion and abrasion resistant refractory composition consisting essentially of: 84 to 87 wt. % $Al_2O_3$; 8 to 10 wt. % C; 3 to 5 wt. % $SiO_2$; and 0.5 to 2 wt. boron containing antioxidant, the pouring member including a tube portion formed integrally with said plate and having a tube bore axially aligned with the plate bore, wherein the erosion and abrasion resistant material also forms a surface of the tube bore extending downwardly a distance of at least 75 mm as measured from the upper surface of the top plate portion to encompass a turbulent metal flow zone within said tube bore.

7. A tundish nozzle and copressed integral plate for use with a flow control valve of a continuous steel casting apparatus comprising:

a plate portion having a bore therethrough and having a flat upper surface vherein at least said upper surface is made from an erosion and abrasion resistant refractory material containing: 75 to 95 wt. % $Al_2O_3$; 5 to 15 wt. % C; up to 10 wt. % $SiO_2$; and up about 3 wt. % antioxidant;

a tube portion, copressed with said plate portion and having a bore therethrough axially aligned with the bore of the plate portion to permit the passage of molten steel therethrough, said tube portion made from a thermal shock resistant refractory; and said erosion and abrasion resistant refractory material forming a surface around the bore of the plate portion extending downwardly into the bore of the tube portion a distance at least about 50 mm, as measured from the upper surface of the plate portion, to surround a turbulent metal zone existing in said tube bore when the valve is in a throttling position.

8. A refractory pouring member for use in the continuous casting of steel, the pouring member comprising a tube portion having a tube bore and copressed with a plate having a plate bore axially aligned with the tube bore, the plate having at least a surface portion formed from an erosion and abrasion resistant material, the material also forming a surface of the tube bore extending downwardly along the tube bore a distance of 50 to 300 mm from an upper surface of the plate to encompass a turbulent metal flow zone.

9. The pouring member of claim 1 wherein the erosion and abrasion resistant surface extends downwardly along the tube bore a distance of at least about 75 mm, as measured from the upper surface of the top plate portion.

10. The tundish nozzle and integral slide plate of claim 1 wherein the erosion and abrasion resistant refractory material extends along the bore of the tube portion a distance of at least about 50 mm as measured from the upper surface of the plate portion.

11. The tundish nozzle and integral slide plate of claim 8 wherein the erosion and abrasion resistant refractory material extends a distance of between about 50 to about 300 mm.

12. The tundish nozzle and slide plate of claim 8 wherein substantially the entire length of the tube bore surface is formed from said erosion and abrasion resistant refractory material.

* * * * *

UNITED STATES PATENT AND TRADEMARK OFFICE

CERTIFICATE OF CORRECTION

PATENT NO. : 5,954,989

DATED : September 21, 1999

INVENTOR(S) : Roger W. Brook et al.

It is certified that error appears in the above-identified patent and that said Letters Patent is hereby corrected as shown below:

Column 10 Line 46, Claim 7, "vherein" should read --wherein--.

Column 10 Line 49, Claim 7, "up about 3" should read --up to about 3--.

Column 11 Line 5, Claim 9, "of claim 1" should read --of claim 7--.

Column 11 Line 9, Claim 10, "of claim 1" should read --of claim 7--.

Signed and Sealed this

Twenty-fifth Day of April, 2000

*Attest:*

Q. TODD DICKINSON

*Attesting Officer*

*Director of Patents and Trademarks*